US005158182A

United States Patent [19]

Fischer-Helwig et al.

[11] Patent Number: 5,158,182

[45] Date of Patent: Oct. 27, 1992

[54] SIFTER

[75] Inventors: Frank Fischer-Helwig, Cologne; Albert Suessegger, Bergisch-Gladbach; Albrecht Wolter, Cologne, all of Fed. Rep. of Germany

[73] Assignee: Kloeckner-Humboldt-Deutz AG, Fed. Rep. of Germany

[21] Appl. No.: 711,030

[22] Filed: Jun. 6, 1991

[30] Foreign Application Priority Data

Jun. 8, 1990 [DE] Fed. Rep. of Germany ..... 4018361
Apr. 12, 1991 [DE] Fed. Rep. of Germany ..... 4112018

[51] Int. Cl.[5] ..... B07B 7/083; B07B 11/06

[52] U.S. Cl. ..... 209/135; 209/139.2; 209/148; 241/79.1

[58] Field of Search ..... 209/133, 134, 135, 142, 209/143, 148, 146, 150, 139.2, 144, 139.1, 154; 241/79.1

[56] References Cited

U.S. PATENT DOCUMENTS 3,275,140 9/1966 Rasmussen ..... 209/139.2
3,960,714 6/1976 Strauss ..... 209/139.2
4,066,535 1/1978 Strauss ..... 209/139.2
4,260,478 4/1981 Hosokawa et al. ..... 209/139.2
4,296,864 10/1981 Misaka et al. ..... 209/148 X
4,693,811 9/1987 Lohnherr ..... 209/139.2
4,756,428 7/1988 Jaeger ..... 209/135

FOREIGN PATENT DOCUMENTS 3924826 1/1991 Fed. Rep. of Germany .
241869 1/1987 German Democratic Rep. ..... 209/144
1475734 4/1989 U.S.S.R. ..... 209/142

*Primary Examiner*—Donald T. Hajec
*Attorney, Agent, or Firm*—Hill, Van Santen, Steadman & Simpson

[57] ABSTRACT

A rotary sifter for separating different fractions of particulate material having a cylindrical outer housing and three rotary cages with vertical bars through which material and air pass inwardly with the cages independently rotary mounted, and channels communicating with the spaces below the rotors for collecting the separate fractions of separated material, and additional air delivery means to each of the channels which collect the separated fractions.

19 Claims, 2 Drawing Sheets

SIFTER

BACKGROUND OF THE INVENTION

The invention relates to improvements in sifters or separators having a plurality of concentric rotatably mounted rotors wherein particulate material and air passes through the rotors and fractions of material are separated.

The separator is commercially useful separating various types of commercial materials but in particular is well suited for separating such materials as the output from a cement processing kiln and such as the output from a high pressure press operating as an interparticle crushing press and delivering particulate material and agglomerates.

German Patent Application P 39 24 826.7 discloses a separator of the above type wherein separating rotors are arranged at a distance above one another. A separate conduit for the sifting air admission and a separate conduit for the sifting air discharge are provided for each sifter rotor. This arrangement is intended to prevent fine material from proceeding into the middlings and middlings from proceeding into the coarse material when sifting granular particulate material so that a clear separation of the respectively desired grain fractions from one another is obtained with a high yield well suited for commercial production.

In such separators, it is necessary to obtain a high continuous output of sufficient capability to handle the output of a press or other machinery preceding the separator. Also, the mechanism must be capable of improved clear separation without intermixing of the fractions.

FEATURES OF THE INVENTION

An object of the present invention is to provide an improved separator for the separation of particulate material capable of avoiding disadvantages present with prior art structures and methods and wherein the device is particularly capable of continual operation at high outputs. A further object of the present invention is to provide a separator for the separation of particulate material into fractions and capable of handling agglomerates and particulate material having a wide range of grain size.

A still further object of the invention is to provide a rotary sifter or separator capable of receiving a continuous supply of air and particulate material and successfully separating the material into distinct fractions well defined from each other.

A further object of the invention is to provide a separator having rotary parts wherein the structural height of the separator is reduced without sacrificing high yield and clear separation of the desired grain fractions and wherein the apparatus is capable of simplified construction and operates at a relatively low energy consumption.

In accordance with the features of the invention, the preferred embodiment includes a plurality of separator rotors concentric with each other and independently mounted and constructed so that they can be driven independently of one another. This construction enables the drives of the rotors at different speeds so that an optimum radially inward flow of material and air can be achieved for an improved fractional separation of the material.

In the arrangement preferred, the particulate material to be separated can be deposited outwardly of the outer rotor and the outer rotor can have a material distributing plate at the top which in the rotation of the rotor permits full functioning of the rotor yet permits centrifugal distribution of the material in an outwardly flinging direction and in one particular arrangement, a separate passage is provided to deliver additional material between an outer rotor and an intermediate rotor. This distributing plate is particularly useful in obtaining uniform distribution of the material around the outer rotor but achieves a loosening and deagglomeration of the charging stock where such agglomerates are received particularly from an interparticle crushing press and this operation substantially contributes to the efficient separation of the fractions by separating agglomerates before they begin to be separated into fractions.

In a further arrangement, at least one sifting air conduit is connected to a housing below the sifter rotors wherein air is received into the collector channels below the rotors. This additional air is controlled so that a reseparation or resifting or control is obtained by supplying secondary sifting air from below the rotors and the sifting effect of the rotors can be further controlled and further benefitted.

Other objects, advantages and features will become more apparent with the teaching of the principles of the invention in connection with the disclosure of the preferred embodiments in the specification, claims and drawings, in which:

DESCRIPTION OF THE PREFERRED EMBODIMENTS

Figure 1:
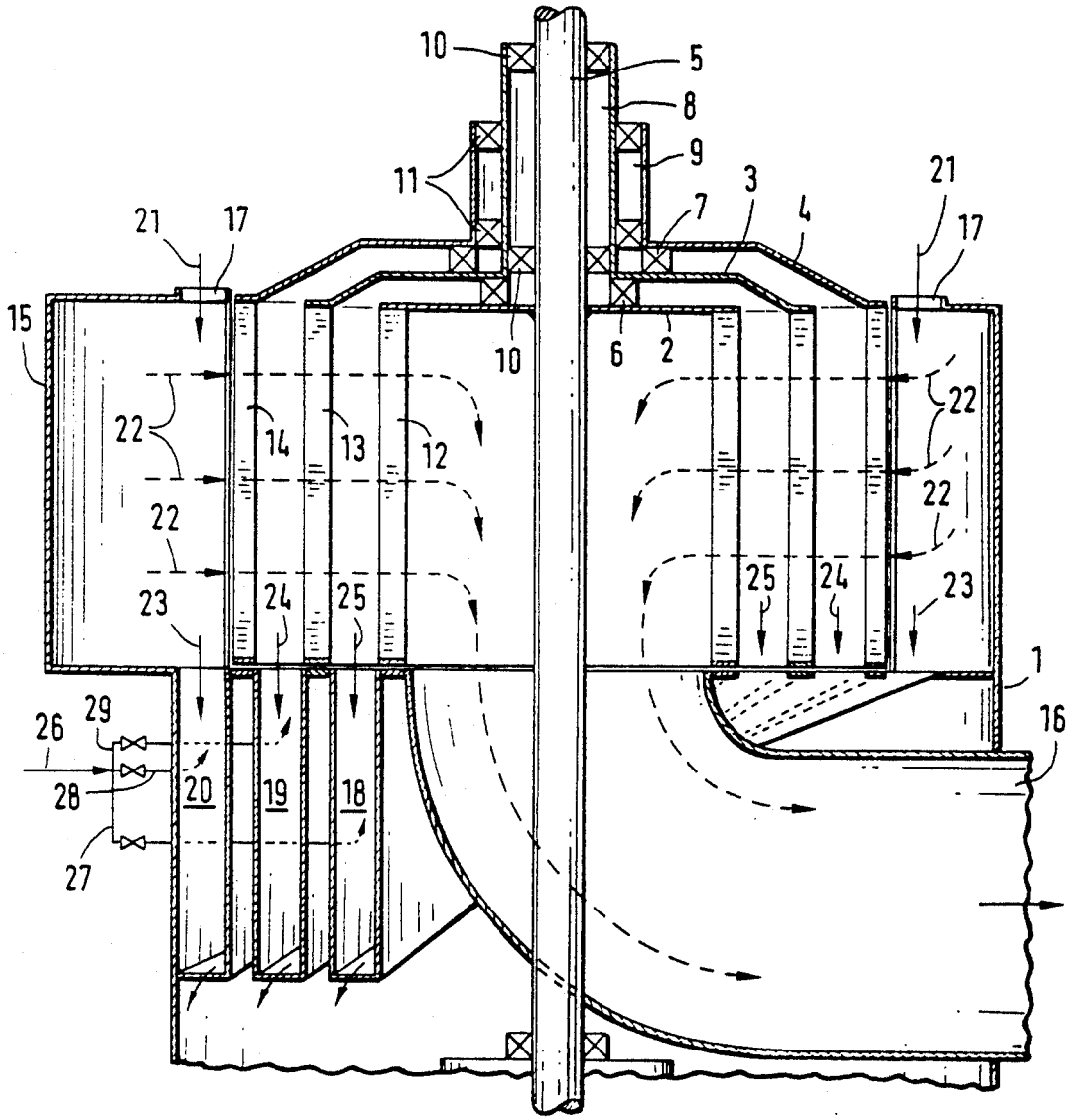
FIG. 1 is a vertical sectional view taken through the axis of a rotary sifter, shown in somewhat schematic form, of a separator constructed and operating in accordance with the principles of the present invention.

As illustrated in FIG. 1, a separator is illustrated including a vertical circular outer housing 1. Within the housing are a plurality of rotatable supported rotors 2, 3 and 4 which are nested within one another in a concentric arrangement to provide spaces between the rotors. An inner rotor 2 is rotatably supported on a central drive shaft 5. An intermediate rotor 3 is independently supported on a rotary bearings 10 and 6 and may be arranged to be separately driven by a separate drive, not shown. The intermediate rotor has a vertical tubular collar 8 which enables support of the rotor on the bearings which are supported concentric on the center shaft 5. As will be recognized, the collars 8 and 9 provide spaces for driving the rotors independently such as by gearing or belts or other suitable drive means. An outer rotor is also independently supported on bearings shown generally at 11 and a vertical collar 9 carries the outer rotor on the bearings for rotational stability.

With this arrangement, each of the rotors can be independently driven so as to obtain rotational speed differentials between the rotors to obtain the optimum flow of air radially inwardly through the rotors for sifting. This permits independent control and selection of speed in accordance with the materials being separated and the flow of air and material supplied to the separator as a whole.

Each of the rotors are similarly constructed to the extent that they are provided with vertical rods to form cages with the rods being designated at 12, 13 and 14 for the inner, intermediate and outer rotors. The rods are sized and circumferentially spaced so as to provide radially inward passages therebetween and the rod sizes and distribution numbers can be selected so that the available flow space for the inward passage of air diminishes for participating in the separation process to separate the material into different fractions. By the control of the radial spaces between the rods, a balance can be attained for air flowing radially inwardly and air flowing outwardly with the separate fractions as well as accommodating a counterflow of air which is supplied between the rotors as will become clear with further description of the structure and its operation.

A balancing for the passage area between the bars in the rotors with the passage decreasing radially from the outside to the inside can be also determined on the basis of the height of the sifter rotors. It is essentially the total flow area that controls the velocity of flow inwardly. With this size control, the flow of the sifting air remains approximately the same or in some instances, decreases at each of the sifter rotors. For this purpose, of course, the thickness of the vertical rods can be varied so that thicker rods are used on the outer rotor and the size of the rods decrease from the outer to the intermediate to the inner rotor.

The housing 1 may have a conduit shown generally in the location at 15 for conducting air to the housing. Such a conduit may be provided with air or baffle elements to control the velocity of flow and the direction of flow into the housing. Such air baffle elements may have adjusted louvers but may feed radially or in some instances into the top of the housing at 21 to move toward the outer rotor 4.

At the lower portion of the housing is a conduit 16 which communicates within the interior of the inner rotor 2 for carrying away the excess air from the separator.

At the top of the housing, openings 17 are provided for the delivery of material to be sifted. The particulate material may be delivered to the same openings or be delivered radially into the outer wall of the housing at 15 as previously described.

Below the housing are discharge channels 18, 19 and 20 that are generally annularly arranged to communicate with the spaces between the rotors with the outermost channel 10 communicating with a housing space which space receives the air and the material. The channels 18, 19 and 20 also increase in vertical depth in an oblique arrangement preferably in the direction of rotation of the rotor so that the depth increases in a rotational direction. The channels are so dimensioned so that the space is determined as a function of the space between the rotors. With the arrangement as shown, the mixing of any of the grain fractions that are already separated from one another and separated from the sifting airstream is avoided.

During operation of the separator, as shown in FIG. 1, the rotors 2, 3 and 4 are driven in rotation by a drive mean driving the shaft 5 and the collars 8 and 9. Sifting air is supplied to the sifter via the conduit area 15. Material to be sifted is delivered as indicated by the arrow 21 through the openings 17 The sifted material is seized by the downwardly flowing airstream which turns to flow inwardly as indicated by the directional arrows 22. Due to the inwardly increasing circumferential speed of the different rotors or baskets 14, 13 and 12, a separation of the charging stock occurs into three fractions. The coarsest material will be deposited downwardly as indicated by the arrow 23 into the channel 20. The middlings will pass downwardly as indicated by the arrow 24 into the channel 19. The fine material will pass downwardly as indicated by the arrow 25 into the channel 18. These channels 18, 19 and 20 lead to separate collector or conveyor means for further processing of the material. As described, a fourth fraction is collected and this is the fraction which is retained by the sifting air flowing radially inwardly to the inside of the inner rotor 12 and this material is discharged downwardly and outwardly through the conduit 16. This finest fraction can be utilized such as being passed to a filter or cyclone.

A preferred arrangement provides for the provision of a counterflow of air in an upward direction into the spaces between the rotors with the air conveniently injected at the base of the spaces into the channels which are provided for conducting away the separated fractions. To provide this air, an air supply conduit 26 is supplied with pressurized air from a suitable source and delivers to branch conduits 27, 28 and 29. The flow of air into the individual spaces and into the individual channels 18, 19 and 20 is obtained by valves controlling the flow through each of the branch conduits 27, 28 and 29. As is illustrated, one of the branch conduits leads directly into the housing of the sifter where the first coarse fraction falls. This additional secondary sifting air flow opposite to the direction of the downwardly dropping fractions which fall as shown by the arrowed lines 23, 24 and 25. The air flows in an upward direction into the free spaces between the rotors and then proceeds inwardly to the inside of the baskets flowing along with the sifting airstreams 22. The air is discharged toward the outside via the conduit 16 as shown by the broken arrowed lines.

The fractions which drop downwardly as indicated by arrows 23, 24 and 25 are subjected to a reclassification or resifting by the secondary sifting air flowing upwardly from the bottom to the top of the spaces. This helps in that any potential outsize fraction that is included in the downwardly dropping fraction is seized and separated from the fraction by the counterflow of air. The separating effect of the sifter can be improved in this manner.

Figure 2:
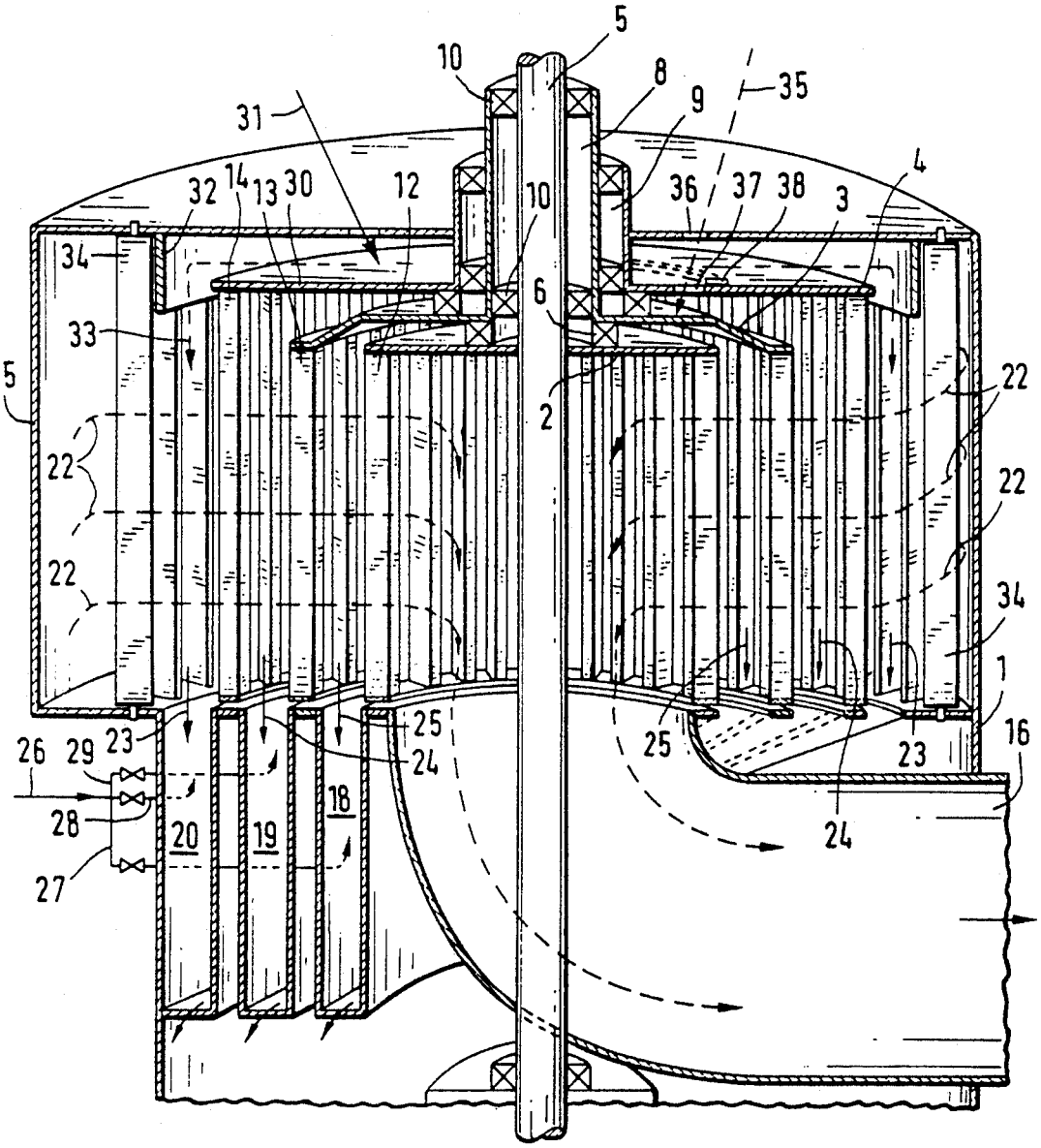
FIG. 2 is another vertical sectional view similar to FIG. 1 but shown partially in perspective view and illustrating a modified form of structure embodying the principles of the invention.

As illustrated in FIG. 2, a flat circular material distributing plate 30 is mounted at the top of the outer rotor 4. This plate receives material being charged into the housing from above as indicated schematically by the arrowed line 31. The charging stock drops down onto the distributing plate and is radially hurled in an outward direction. This stock hurled outwardly strikes an annular downwardly depending impact ring 32 which is supported in the sifter housing at a distance outwardly from the edge of the distributing plate 30. Material thus hitting the impact ring or skirt 32 drops downwardly in the direction of the arrowed line 33 into the sifting airstream 22. Due to the impact of the product against the impact ring 32, agglomerates or coarser pieces of product which may still potentially be present in the charging stock are comminuted or deagglomerated before they proceed into the sifting airstream. As stated above, agglomerates may be caused in the charging material from various causes such as by being formed in the kiln of a cement processing operation or in the high pressure press of a product comminuting press. The distributing plate 30, or at least its upper surface, has a highly wear resistant material or coating to withstand the abrasion of the impact of the material and the impact of agglomerates and coarser pieces of product.

In order to promote comminution or deagglomeration of sections of product, the outer region of the distributing plate can be additionally equipped with slinger blades or beater elements, not shown in detail, but shown schematically by the ring 38. The charging stock pretreated in this way proceeds into the interspace between the sifting air baffle elements 34 and the rods of the rod basket 14 of the outer rotor 4. Here the dropping product is seized by the sifting airstream shown by the arrow 22 and is inwardly entrained and is separated into three fractions in the manner set forth above in connection with the description of the sifter of FIG. 1.

The sifter of FIG. 2 does not differ materially from the sifter of FIG. 1 with respect to other component parts and particularly with respect to the arrangement of the rotors and the drive as well as the sifting air admission and delivery of primary and secondary air, and therefore component parts and drives are similarly numbered in FIG. 2 to correspond with the numbering in FIG. 1.

The drive of the rotors 2, 3 and 4 in the sifter shown in both FIGS. 1 and 2 is obtained from above. It is also possible, however, to drive the rotors from below or if a sifter is utilized having two rotors, to drive one rotor from above and the other from below. In this arrangement, the discharging of sifting air can also be displaced toward the top or can occur upwardly out of the sifter. Further, it also may be expedient to undertake the discharge of the middling fraction shown by the arrow 24 and the discharge of the fine fraction shown by the arrow 25 by withdrawing an air substream.

The principles of the invention can also be utilized in providing a two cut sifter which can be used in the partial finished grinding of cement clinker. For this purpose, the cement clinker that is pressed into scabs in a high pressure roller press and is subsequently deagglomerated and comminuted is delivered to the sifter in FIG. 2 from above in the direction of the arrow 31. The first fraction separated in the sifter, which is the coarse material shown by the arrowed line 23 is returned into the high pressure roller press. The middlings dropping at the arrow 24 are supplied to a regrinding unit such as a ball mill and are correspondingly recomminuted therein. This reground material is then either delivered to the sifter at the arrow 35 through corresponding openings 36 and 37 in the sifter housing onto the material distribution plate 30 and the material is introduced into the free space between the sifter rotors 3 and 4 traversed by the sifting air. It is then sifted therein or is directly added to the finished product. The grain fraction dropping at arrow 25 dropped in a downwardly direction from the sifting airstream is eliminated to the outside from the channel 18 and represents a second fraction which is the finished product. A third finest fraction is carried inwardly by the sifting air through the rods of the rotor and is then discharged via the sifting air through the discharge conduit 16 as a third finished product. In a sifter having only two sifter rotors, the second fraction is discharged from the sifter with the sifting airstream as a finished product and is separated from the sifting air in a separator or filter connected to the sifter. In order to prevent parts of the sifter charging stock from being hurled outwardly by the material distributor plate 30, an annular rib 38 is mounted on the material distributing plate 30 outwardly of the openings 37.

As an alternative to the embodiment of FIG. 2, there is a possibility of delivering the charging stock 35 onto the deck of the rotor 2 through the shaft 5 in which case the shaft would be constructed hollow and appropriate openings would be placed in the wall of the shaft for radial release of the material.

The sifter rotors 2, 3 and 4 in the rotors illustrated in the drawing can be driven in the same direction of rotation and can be driven with the same or different rotational speeds. They also can be driven in oppositely directed rotational senses with the same or different rotational speeds in order to optimally adapt the sifter to the respective product to be sifted. There is also the possibility of utilizing the sifter of the invention for sifting especially fine grained material into a plurality of fractions whereby gases such as argon or the like are utilized instead of sifting air for a clear separation of the individual fractions from one another.

For homogenizing the sifting airstream through the openings between the rods 12, 13 and 14 of the rotors, and for improving the separating effect, a profiling of the rods can be used. For example, the rods can be shaped such as in a turbine construction. Further, the free openings between the rods for the passage of sifting air from each rod basket to the next can be arranged so that the air passage area can be arranged to be essentially constant. In some instances, this can be arranged to be increasing. As will be appreciated, this can be accomplished by the size and number of the rods chosen so that the spacing can be increased either by the provision of smaller rods or by a greater circumferential separation of adjacent rods.

Further, more sifter rotors can be utilized than those shown concentrically nested in one another and can be arranged at a corresponding distance from each other or the spacing between baskets can be varied dependent upon the type of separation to be incorporated, although uniform spacing is preferred. As stated, the different rotors can be operated at different rotational speeds. The comminution effect of the sifter can also be intensified by arranging scattering elements or beater elements on the material distributing plate 30.

Thus, it will be seen there has been provided a sifter which provides an effective commercial device of simple and compact structure offering many possibilities of variation and uses. The sifter meets the objectives above set forth and is capability of relatively high capacity operation with corresponding reduction of per unit power input.

We claim as our invention:

1. A rotary sifter for separating fractions of particulate material comprising in combination:

a plurality of rotatably mounted concentric nested rotors including an outer and inner rotor having radial passages for the radial inward flow of air and material;

means defining downwardly facing openings inwardly of each of the rotors for the downward discharge of fractions of material between rotors;

an outer cylindrical upright housing enclosing the outer rotor and having an inlet so that air flows from the housing inwardly through the radial passages in the rotors;

and means delivering material outwardly of the outer rotor to be caught up by the air flowing inwardly so that fractions of material are separated by passing through each of the rotors with the more coarse fraction passing downwardly from the outer rotor and a more fine fraction passing downwardly from the inner rotor.

2. A rotary sifter for separating fractions of particulate material constructed in accordance with claim 1:

wherein the rotors are rotatably mounted independent of each other and means are provided for separately driving each of the rotors.

3. A rotary sifter for separating fractions of particulate material constructed in accordance with claim 1:

wherein said air inlet is located at the top of said housing and at the level of the outer rotor and a conduit is located within and below the inner rotor for the discharge of air.

4. A rotary sifter for separating fractions of particulate material constructed in accordance with claim 1:

wherein each of said rotors is provided with vertical rods to provide said radial passages for the rotors, said rods having sizes to provide a predetermined size for the radial passage through the rotor for obtaining a predetermined velocity of air flow through each of said rotors.

5. A rotary sifter for separating fractions of particulate material constructed in accordance with claim 1:

including a horizontal distributing plate mounted at the top of the outer rotor;

and said material delivery means located above said plate so that particulate material is circumferentially thrown outwardly after engaging the plate to descend downwardly outwardly of the outer rotor.

6. A rotary sifter for separating fractions of particulate material constructed in accordance with claim 5:

including an opening in said distributing plate communicating in the space within the outer rotor so that material discharges downwardly into the space between said rotors.

7. A rotary sifter for separating fractions of particulate material constructed in accordance with claim 1:

including a further air conduit means connected to the housing below the sifter and communicating with space between the rotors.

8. A rotary sifter for separating fractions of particulate material constructed in accordance with claim 7:

wherein said further air conduit is connected to at least of said downwardly facing openings.

9. A rotary sifter for separating fractions of particulate material constructed in accordance with claim 1:

wherein said downwardly facing openings include annular channels for receiving the flow of fractions of material.

10. A rotary sifter for separating fractions of particulate material constructed in accordance with claim 9:

wherein said annular channels increase in depth vertically in the direction of rotation of the rotors.

11. A rotary sifter for separating fractions of particulate material constructed in accordance with claim 1:

including a flat surface distributing plate at the top of the outer rotor with a downwardly directed opening in the distributing plate communicating inwardly of the outer rotor for a partial distribution of material.

12. A rotary sifter for separating fractions of particulate material constructed in accordance with claim 11:

including a rib positioned radially outwardly of the opening for limiting the amount of material thrown outwardly of the plate.

13. A rotary sifter for separating fractions of particulate material constructed in accordance with claim 1:

wherein the radial passages are of a predetermined size so that inward flow of air and material proceeds at uniform velocity radially inwardly.

14. A rotary sifter for separating fractions of particulate material constructed in accordance with claim 1:

wherein each of the rotors has a plurality of circumferentially distributed vertical bars sized so that the circumferential spacing maintains a uniform velocity of inward flow of air and material.

15. A rotary sifter for separating fractions of particulate material comprising in combination:

a vertically situated circumferential outer housing having an inlet at an upper end so that air is received in the housing;

a plurality of rotatably mounted concentric nested rotors within the housing including an outer and an inner rotor with said rotors having radial passages for the radial inward flow of air and material;

means for delivering particulate material outwardly of the outer housing to be caught up by the air flowing inwardly;

annular channels inwardly of each of the rotors for receiving fractions of material passing downwardly separated from the inward flow of air between the rotating rotors;

and means for delivering a controlled flow of updraft air into the discharge passages to generate updrafts.

16. A rotary sifter for separating fractions of particulate material constructed in accordance with claim 15:

including valve means for controlling the quantity of air delivered to furnish said updrafts.

17. A rotary sifter for separating fractions of particulate material constructed in accordance with claim 15:

including a circular plate mounted at the top of the outer rotor;

means for delivering material to the top of said plate;

an annular downwardly directed skirt mounted outwardly of said plate for impacting and directing the flow of material circumferentially delivered from said plate in a downward direction.

18. A rotary sifter for separating fractions of particulate material constructed in accordance with claim 15:

said housing having a plurality of vertically extending rods through which the air passes inwardly to the outer rotor;

and means for delivering material into the space between the rods of said housing and said outer rotor.

19. A rotary sifter for separating fractions of particulate material comprising in combination:

an outer cylindrical upright housing for receiving a supply of air to flow inwardly;

a plurality of vertical rods mounted in said housing through which the air flows inwardly;

a first outer rotor rotatably mounted within the housing for receiving inwardly flowing air;

a second intermediate rotor within the outer rotor concentrically mounted within the outer rotor;

an inner rotor concentrically mounted within the intermediate rotor;

a separate drive means for each of the rotors driving the rotors at independent speeds;

a material delivery means in the housing for delivering material outwardly of the outer rotor;

vertical rods for each of the rotors having air and material flow spaces therebetween and being of a different size to provide air passages of different sizes for obtaining a predetermined velocity of flow through each of the rotors;

an annular flat plate mounted at the top of the outer rotor for receiving material and flinging the material outwardly of the outer rotor;

a vertical depending annular skirt outwardly of said plate for deflecting the material downwardly;

an opening through the flat plate communicating with the space between outer and intermediate rotor for the passage of a limited amount of particulate material;

a rib outwardly of the opening for indirectly controlling the amount of material passing through the opening;

means defining material receiving channels independently communicating with the spaces between each of the rotors and with the space outwardly of the outer rotor;

separate air delivery means communicating with each of said channels;

air flow control valve means for each of the air delivery passages communicating with the channels;

and a central air exhaust conduit receiving air from within the inner rotor.

* * * * *